US008142232B1

(12) United States Patent
Song et al.

(10) Patent No.: US 8,142,232 B1
(45) Date of Patent: Mar. 27, 2012

(54) THREE CONNECTORS MUTUALLY CONDUCTIVE AND DETACHABLY CONNECTED TO EACH OTHER

(75) Inventors: Keun Sung Song, Gyeonggi-do (KR); Young Geun Park, Gyeongsangbuk-do (KR); Ig Kyun Jeon, Incheon (KR)

(73) Assignees: Hyundai Motor Company, Seoul (KR); Kia Motors Corporation, Seoul (KR); Tyco Electronics AMP Korea Ltd., Gyeongsan, Gyeongbuk (KR)

( * ) Notice: Subject to any disclaimer, the term of this patent is extended or adjusted under 35 U.S.C. 154(b) by 0 days.

(21) Appl. No.: 12/962,952

(22) Filed: Dec. 8, 2010

(30) Foreign Application Priority Data

Sep. 30, 2010 (KR) ..... 10-2010-0095107

(51) Int. Cl.
*H01R 13/502* (2006.01)

(52) U.S. Cl. ..... 439/701

(58) Field of Classification Search ..... 439/137, 439/138, 502, 701, 347, 355, 157
See application file for complete search history.

(56) References Cited

U.S. PATENT DOCUMENTS

| | | | | |
|---|---|---|---|---|
| 3,399,374 | A * | 8/1968 | Pauza et al. | 439/355 |
| 4,973,859 | A * | 11/1990 | Shodai | 307/10.1 |
| 6,227,115 | B1 * | 5/2001 | Gruber et al. | 102/202.9 |
| 6,935,902 | B1 * | 8/2005 | Chou | 439/701 |
| 7,121,866 | B2 * | 10/2006 | Testa et al. | 439/347 |

FOREIGN PATENT DOCUMENTS

| | | | |
|---|---|---|---|
| EP | 0326367 | A2 | 8/1989 |
| JP | 04085147 | A | 3/1992 |
| JP | 2006086068 | A | 3/2006 |
| JP | 2009110763 | A | 5/2009 |

* cited by examiner

*Primary Examiner* — Chandrika Prasad
(74) *Attorney, Agent, or Firm* — Edwards Wildman Palmer LLP; Peter F. Corless

(57) ABSTRACT

The present invention relates to a combination connector for a vehicle that facilitates a connector assembling process in an in-line assembly line by integrating a connector which is a coupling part for wires extending to various electrical parts. Specifically, several connectors are coupled to one connector so as to be electrically connected to it, thereby concentrating the connector assembling processes in an in-line assembly line at one place and enhancing production yield and/or production rate.

10 Claims, 5 Drawing Sheets

THREE CONNECTORS MUTUALLY CONDUCTIVE AND DETACHABLY CONNECTED TO EACH OTHER

CROSS-REFERENCE TO RELATED APPLICATION

This application claims the benefit of Korean Patent Application No. 10-2010-0095107, filed Sep. 30, 2010, under 35 U.S.C. §119(a). The entire contents of the above-referenced application are incorporated herein by reference.

BACKGROUND (a) Technical Field

The present disclosure is directed to a combination connector for a vehicle. More particularly, it relates to a combination connector for a vehicle that facilitates a connector assembling process in an in-line assembly line by integrating a connector which is a coupling part for wires extending to various electrical parts.

(b) Background Art

As vehicles become more luxurious and multi-functioned due to the enhancement of the performance of engines and the mounting of various convenience devices, many electrical parts and controllers are mounted to the vehicles and a wiring harness, including power lines of various electrical parts, control signal lines, and communication lines between the controllers, and cables, which are installed in an arrangement.

In particular, connectors are mounted to the ends of wiring harnesses or cables for electrical connections to various electrical parts or between the controllers, which connectors are manufactured in different shapes according to the standards of the electrical parts, and the sizes of the in-use wires.

Accordingly, as a plurality of connectors for connecting various wiring harnesses are assembled in an in-line assembly line, the number of processes increases.

For example, as can be seen in FIG. 4, a plurality of connectors are required as a main wire 1 for a power supply, and a front wire 2 extending to the front of the chassis, the main wire 1 and a floor wire 3 extending to the bottom of the chassis, and the front wire 2 and the floor wire 3 are connected to each other through connectors 4, and the assembling positions of the connectors 4 are different. Such an arrangement increases the number of connector assembling processes.

In particular, when a connector is assembled at a dash panel and a front pillar of the chassis, the assembling space for a worker is narrow. As the worker performs an assembling operation with his head being lowered, it is difficult to couple the connector, severely lowering work efficiency.

Considering the aforementioned problems, as illustrated in FIG. 5, a multi-box 5 having a large volume for gathering a plurality of connectors 4 at random has been suggested. However, a big hole 6 has to be formed at a position of an in-line assembly line where connectors are assembled to install the large-volume multi-box 6, raising various restrictions in installing a large volume multi-box, which is disadvantageous in the aspect of cost.

SUMMARY OF THE DISCLOSURE

The present invention has been made in an effort to solve the above-described problems associated with prior art. Specifically, it is an object of the present invention to provide a combination connector for a vehicle in which two connectors are coupled into a third connector so as to be electrically connected to the third connector so that electrical connections between the connectors are easily carried out with one connector, and the connectors can be assembled in an in-line assembly line, thereby increasing production yield and production rate.

In one aspect, the invention provides a combination connector for a vehicle comprising: a first connector having a plurality of connecting ports, a second connector divided into a cap housing and a plug housing, wherein the second connector is inserted into the connecting ports in the first connector so as to be electrically conductive to or separate from the first connector, and a third connector, wherein the third connector is inserted into the first connector and the second connector so as to be electrically conductive to or separate from the first connector and the second connector.

In one embodiment, the invention provides for a combination connector, wherein an opened positioning hole, a first connecting port, and a second connecting port are formed at an upper portion of the first connector and a first wiring harness is connected to a bottom portion of the first connector.

In another embodiment, the invention provides for a combination connector, wherein the plug housing is electrically conductively coupled to the first connecting port of the first connector and the cap housing of the second connector is positioned within the positioning hole of the first connector, and wherein the third connector is electrically conductively coupled to the second connecting port of the first connector and the cap housing of the second connector.

In a further embodiment, the invention provides for a combination connector, wherein the first wiring harness connected to the first connector is employed as a floor wiring, a second wiring harness connected to the second connector is employed as a front wiring, and a third wiring harness connected to the third connector is employed as a main wiring.

In another embodiment, the invention provides for a combination connector wherein only the first connector is fixedly mounted to a chassis panel to be assembled.

In other embodiments, the invention provides for a combination connector wherein a lever is hingedly mounted to opposite upper ends of the third connector, wherein the lever is used as a handle for an assembling process.

In another aspect, the present invention provides a combination connector for a vehicle comprising: a first connector having a positioning hole, a first connecting port, and a second connecting port and to which a first wiring harness is connected; a second connector having a cap housing and a plug housing and to which a second wiring harness is connected; and a third connector to which a third wiring harness is connected, wherein the plug housing of the second connector is electrically conductively coupled to the first connecting port of the first connector and the cap housing of the second connector is positioned within the positioning hole of the first connector, and wherein the third connector is electrically conductively coupled the second connecting port of the first connector and the cap housing of the second connector at the same time.

In certain embodiments, the first wiring harness connected to the first connector may be employed as a floor wiring, the second wiring harness connected to the second connector may be employed as a front wiring, and the third wiring harness connected to the third connector may be employed as a main wiring.

In other embodiments, only the first connector may be fixedly mounted to a chassis panel to be assembled.

A lever as a handle for an assembling process may be hingedly mounted to opposite upper ends of the third connector.

In another aspect, the invention provides for a vehicle comprising a combination connector wherein the connector comprises:

a first connector having a plurality of connecting ports, a second connector divided into a cap housing and a plug housing, wherein the second connector is inserted into the connecting ports in the first connector so as to be electrically conductive to or separate from the first connector, and a third connector, wherein the third connector is inserted into the first connector and the second connector so as to be electrically conductive to or separate from the first connector and the second connector.

Through the above-described configurations, the present invention provides the following effects.

According to the present invention, several connectors are coupled to one connector so as to be electrically connected to it, thereby concentrating the connector assembling processes in an in-line assembly line at one place which enhances production yield and enhances production rate.

Further, the paths of wires are simplified and arranged neatly, making it possible to design the wires efficiently.

Furthermore, the present invention does not require a large volume multi-box, reducing manufacturing costs.

In particular, a separate pushing lever is attached to the uppermost connector to easily apply a pushing force for electrical connection to the connector, ensuring electrical connections between the connectors.

BRIEF DESCRIPTION OF THE DRAWINGS

The above and other features of the present invention will now be described in detail with reference to certain embodiments thereof, which are illustrated in the accompanying drawings hereinbelow by way of illustration only, and thus are not limitative of the present invention.

DETAILED DESCRIPTION

Hereinafter, exemplary embodiments of the present invention will be described below in detail with reference to the accompanying drawings such that those skilled in the art to which the present invention pertains can easily practice the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

One goal of the present invention is to insert and position several connectors into a single connector such that the connectors are connected to each other at a single position. As several connectors are assembled at a single position in an in-line assembly line, their assembling efficiency can be enhanced.

Figure 1:
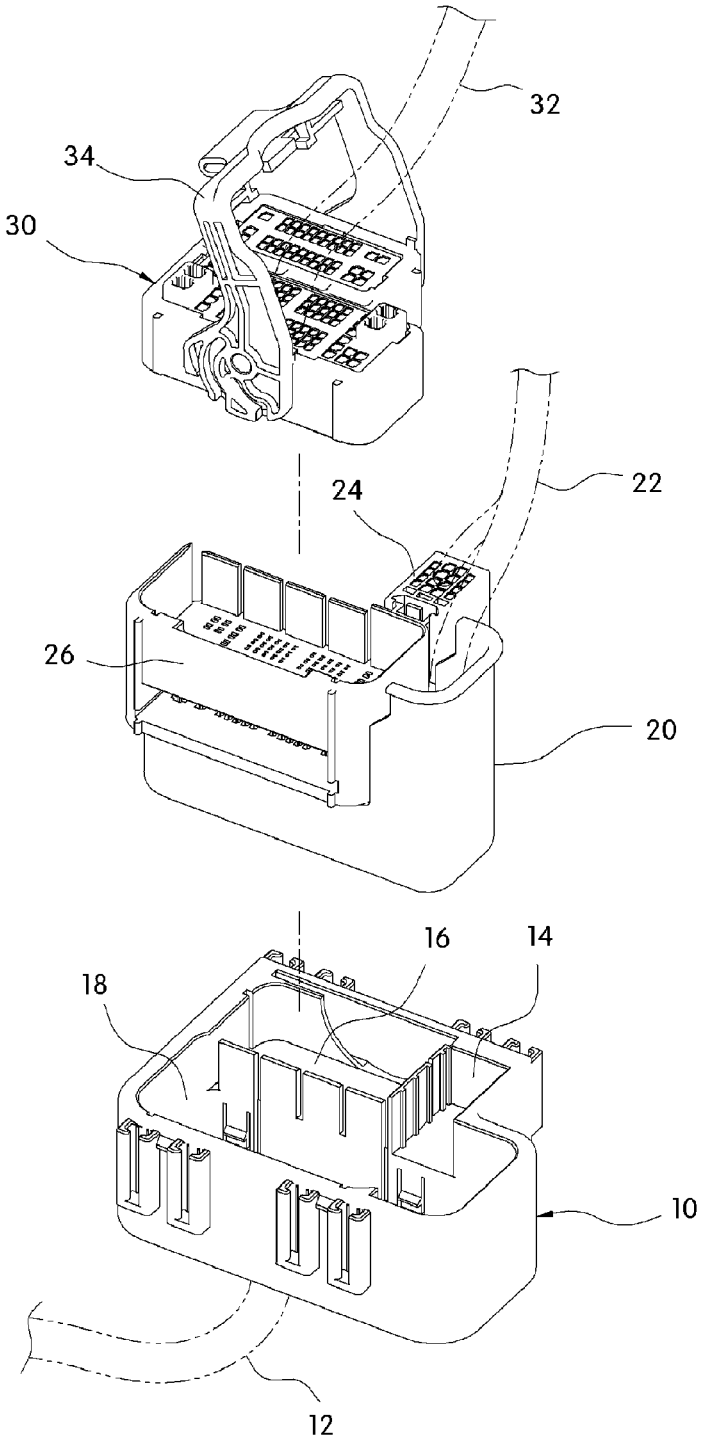
FIG. 1 illustrates various perspective views of a combination connector for a vehicle according to the present invention.
Figure 2:
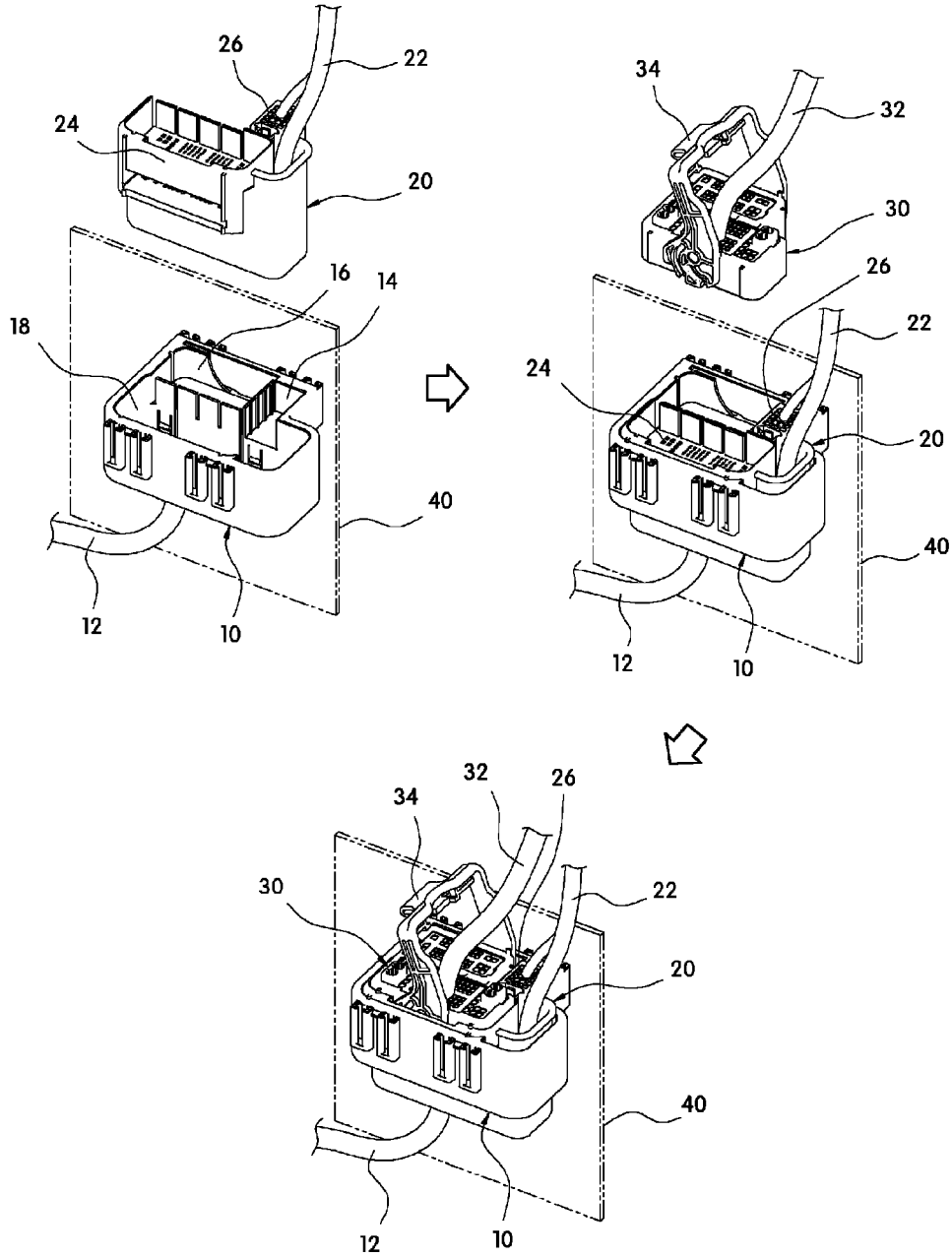
FIG. 2 illustrates perspective views for showing a sequential assembling process of the combination connector for a vehicle according to the present invention.
Figure 3:
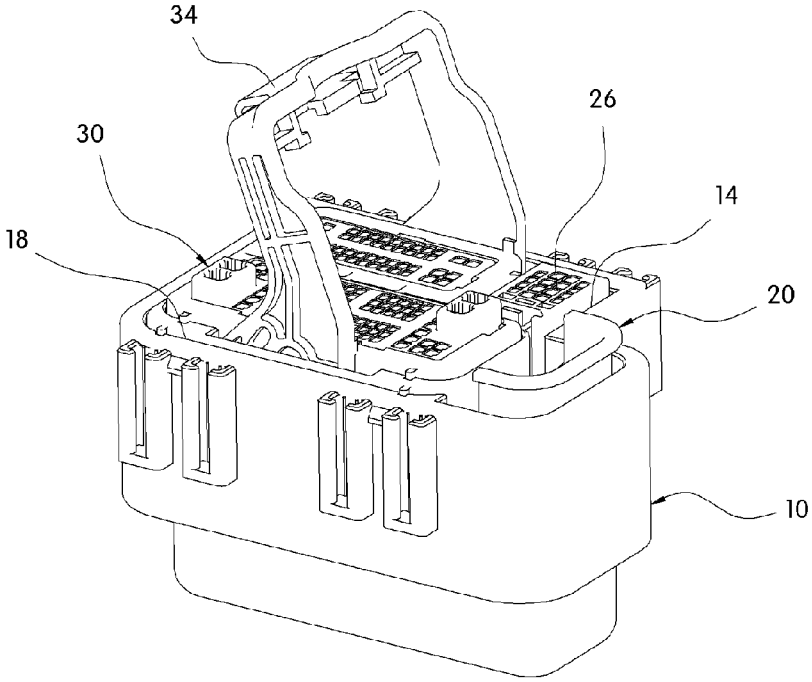
FIG. 3 illustrates a perspective view of an assembled combination connector for a vehicle according to the present invention.
Figure 4:
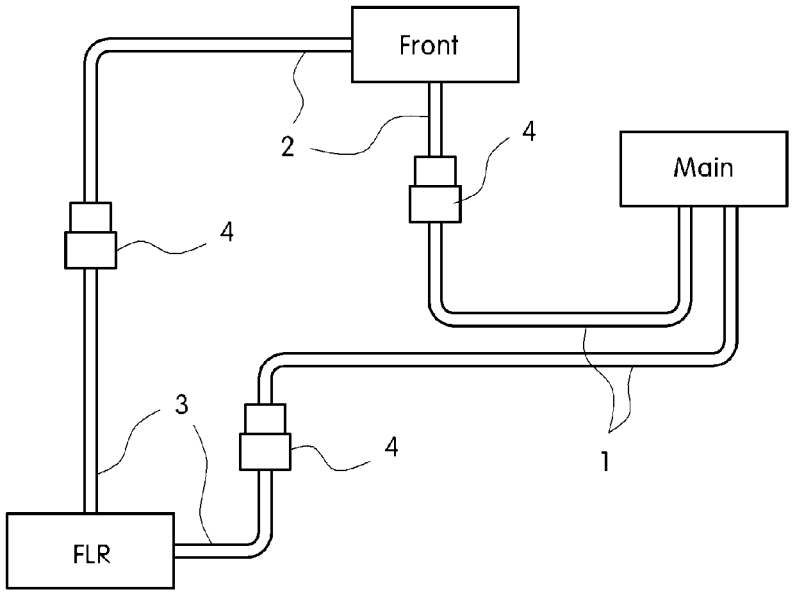
FIGS. 4 and 5 schematically illustrate a conventional connector.
Figure 5:
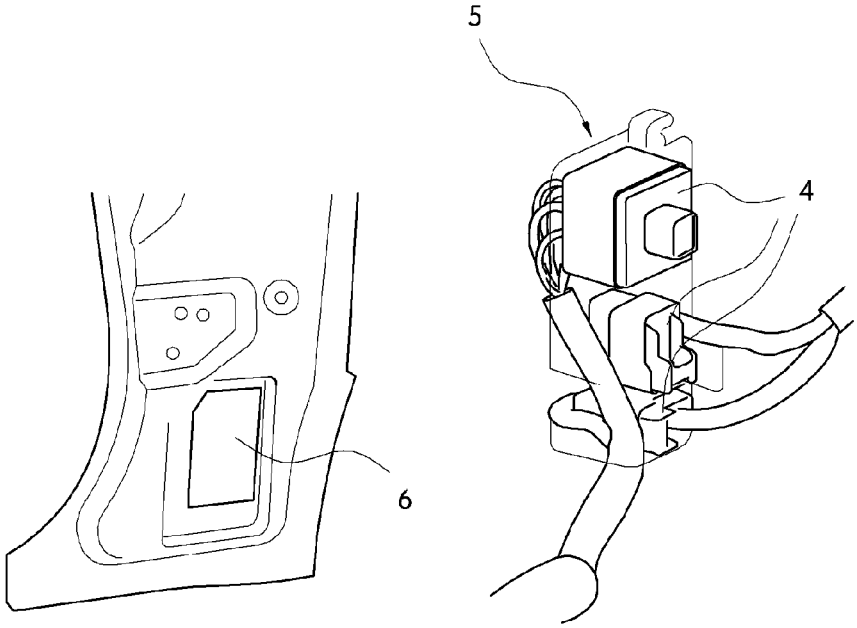

For this purpose, as illustrated in FIGS. 1 to 3, three connectors are provided as an embodiment of the present invention.

Among the three connectors, a first connector 10 has an open-topped box-like shape. A first wiring harness 12, i.e. a floor wiring extending to the floor of the chassis is connected to a bottom portion of the first connector 10, and the first connector 10 has an empty positioning hole 18 at the opened portion thereof. A first connecting port 14 and a second connecting port 16, each having a cap structure with 85 electrical connection pins, are separately formed.

Among the three connectors, a second connector 20 includes a cap housing 24 having 65 electrical connection pins and a plug housing 26 having 24 pins, and a second wiring harness 22, i.e. a front wiring extending toward the chassis front is connected to the top surface of the plug housing 26.

Among the three connectors, a third connector 30 has a plug structure having 126 electrical connection pins and a third wiring harness 32, i.e. a main wiring is connected to the top surface thereof.

Referring to FIG. 2, a process of assembling the first to third connectors is as follows.

First, the first connector 10 is mounted and fixed to the chassis panel (for example, a dash panel, a front pillar, etc.) using a coupling mechanism (a screw, a fastener, a bracket, etc.).

Next, the second connector 20 is inserted into and electrically conductively coupled to the first connector 10.

Specifically, the plug housing 26 of the second connector 20 is coupled to the first connecting port 14 of the first connector 10 and the cap housing 24 is inserted and positioned into the positioning hole 18 of the first connector 10.

The third connector 30 is inserted into the first connector 10 and second connector 20 such that it is electrically conductive to the first connector 10 and the second connector 20 at the same time.

In more detail, the third connector 30 has 126 electrical connection pins, some of which are electrically conductively coupled to the second connecting port 16 of the first connector 10, and the others of which are electrically conductively coupled to the cap housing 24 of the second connector 20.

Then, as a lever 34 as a handle for an assembling process is hingedly mounted to opposite upper ends of the third connector 30, a force for insertion of the third connector 30 can be easily transferred downward and the transferred pushing force is transferred to the first and second connectors 10 and 20 such that the first to third connectors can be completely coupled to each other, ensuring electrical connections between the connectors.

Thus, as the first to third connectors 10, 20, and 30 are electrically connected to each other within the first connector 10, the connector assembling process in an in-line assembly line is concentrated at one position, making it possible to reduce the number of workers and increase production yield and/or production rate. Furthermore, the wiring paths of the floor wiring harness connected to the first connector 10, the front wiring harness connected to the second connector 20, and the main wiring harness connected to the third connector 30 are simplified and arranged neatly.

Although the present invention includes three connectors which are assembled so as to be electrically conductive to each other, combination of more than three connectors may fall in the scope of the present invention.

What is claimed is:

1. A combination connector for a vehicle comprising:

a first connector having a plurality of connecting ports, a second connector divided into a cap housing and a plug housing, wherein the second connector is inserted into the connecting ports in the first connector so as to be electrically conductive to or separate from the first connector, and a third connector, wherein the third connector is inserted into the first connector and the second connector so as to be electrically conductive and separable from the first connector and the second connector.

2. The combination connector of claim 1, wherein an opened positioning hole, a first connecting port, and a second connecting port are formed at an upper portion of the first connector and a first wiring harness is connected to a bottom portion of the first connector.

3. The combination connector of claim 1 or 2, wherein the plug housing is electrically conductively coupled to the first connecting port of the first connector and the cap housing of the second connector is positioned within the positioning hole of the first connector, and wherein the third connector is electrically conductively coupled to the second connecting port of the first connector and the cap housing of the second connector.

4. The combination connector of claim 3, wherein the first wiring harness connected to the first connector is employed as a floor wiring, a second wiring harness connected to the second connector is employed as a front wiring, and a third wiring harness connected to the third connector is employed as a main wiring.

5. The combination connector of claim 1, wherein only the first connector is fixedly mounted to a chassis panel to be assembled.

6. The combination connector of claim 1, wherein a lever is hingedly mounted to opposite upper ends of the third connector, wherein the lever is used as a handle for an assembling process.

7. The combination connector of claim 2, wherein the plug housing is electrically conductively coupled to the first connecting port of the first connector and the cap housing of the second connector is positioned within the positioning hole of the first connector, and wherein the third connector is electrically conductively coupled to the second connecting port of the first connector and the cap housing of the second connector.

8. A motor vehicle comprising a combination connector of claim 1.

9. A motor vehicle of claim 7 wherein the motor vehicle is a passenger automobile.

10. A vehicle comprising a combination connector wherein the connector comprises:

a first connector having a plurality of connecting ports, a second connector divided into a cap housing and a plug housing, wherein the second connector is inserted into the connecting ports in the first connector so as to be electrically conductive to or separate from the first connector, and a third connector, wherein the third connector is inserted into the first connector and the second connector so as to be electrically conductive to and separable from the first connector and the second connector.

* * * * *